US012559929B2

(12) United States Patent
Sato et al.

(10) Patent No.: US 12,559,929 B2
(45) Date of Patent: Feb. 24, 2026

(54) URINAL

(71) Applicant: TOTO LTD., Kitakyushu (JP)

(72) Inventors: Toshihiro Sato, Fukuoka (JP); Yasuo Nambu, Fukuoka (JP); Yuichi Furuta, Fukuoka (JP); Kei Shibata, Fukuoka (JP); Ryoga Ide, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 65 days.

(21) Appl. No.: 18/594,024

(22) Filed: Mar. 4, 2024

(65) Prior Publication Data

US 2024/0328140 A1 Oct. 3, 2024

(30) Foreign Application Priority Data

Mar. 31, 2023 (JP) ..... 2023-056999

(51) Int. Cl.
*E03D 13/00* (2006.01)

(52) U.S. Cl.
CPC ..... *E03D 13/00* (2013.01)

(58) Field of Classification Search
CPC ..... E03D 13/00; E03D 13/002; E03D 13/005; E03D 13/007
See application file for complete search history.

(56) References Cited

U.S. PATENT DOCUMENTS

| | | | | |
|---|---|---|---|---|
| 2,147,588 A * | 2/1939 | Zinkil | E03D 13/00 4/310 |
| 5,305,473 A * | 4/1994 | Nakamura | E03D 9/052 4/306 |
| 6,640,356 B1 * | 11/2003 | Hans | G09F 27/00 340/573.3 |
| 9,988,803 B2 * | 6/2018 | Tani | E03D 13/00 |

FOREIGN PATENT DOCUMENTS

| | | |
|---|---|---|
| EP | 1238386 | 9/2002 |
| JP | 51-85249 | 7/1976 |
| JP | 2003-517159 | 5/2003 |
| JP | 2015-190308 | 11/2015 |
| JP | 1637024 | 7/2019 |

* cited by examiner

*Primary Examiner* — Erin Deery
(74) *Attorney, Agent, or Firm* — Amin, Turocy & Watson, LLP

(57) ABSTRACT

A urinal includes a bowl part, a housing part, and an extension part. The bowl part receives urine on a bowl surface thereof. The housing part is formed on an upper part of the bowl part at a back side thereof and houses a functional part therein. The extension part is formed to extend upward from an upper end part of the bowl surface and forms at least a part of a front wall part of the housing part. The extension part is formed to slope backward from a lower end part thereof to an upper side thereof.

5 Claims, 7 Drawing Sheets

URINAL

CROSS-REFERENCE TO RELATED APPLICATION(S)

This application is based upon and claims the benefit of priority to Japanese Patent Application No. 2023-056999, filed on Mar. 31, 2023, the entire contents of which are herein incorporated by reference.

FIELD

A disclosed embodiment(s) relate(s) to a urinal.

BACKGROUND

A urinal has conventionally been known that is configured to have a housing part that is provided on an upper part of a bowl part that receives urine of a user, at a back side thereof, and house a functional part in the housing part (see, for example, Japanese Patent Application Publication No. 2015-190308).

A functional part as described above has a function of supplying water to a water spout part of a urinal, etc. where a size thereof is different depending on such a function. Hence, for a urinal, holding of a housing space in a housing part without disturbing a design thereof is needed.

SUMMARY

A urinal according to an aspect of an embodiment includes a bowl part that receives urine on a bowl surface thereof, a housing part that is formed on an upper part of the bowl part at a back side thereof and houses a functional part therein, and an extension part that is formed to extend upward from an upper end part of the bowl surface and forms at least a part of a front wall part of the housing part, wherein the extension part is formed to slope backward from a lower end part thereof to an upper side thereof.

BRIEF DESCRIPTION OF DRAWING(S)

DESCRIPTION OF EMBODIMENT(S)

Hereinafter, an embodiment(s) of a urinal as disclosed in the present application will be explained in detail, with reference to the accompanying drawing(s). Additionally, this invention is not limited by an embodiment(s) as illustrated below.

Embodiment

Figure 1:
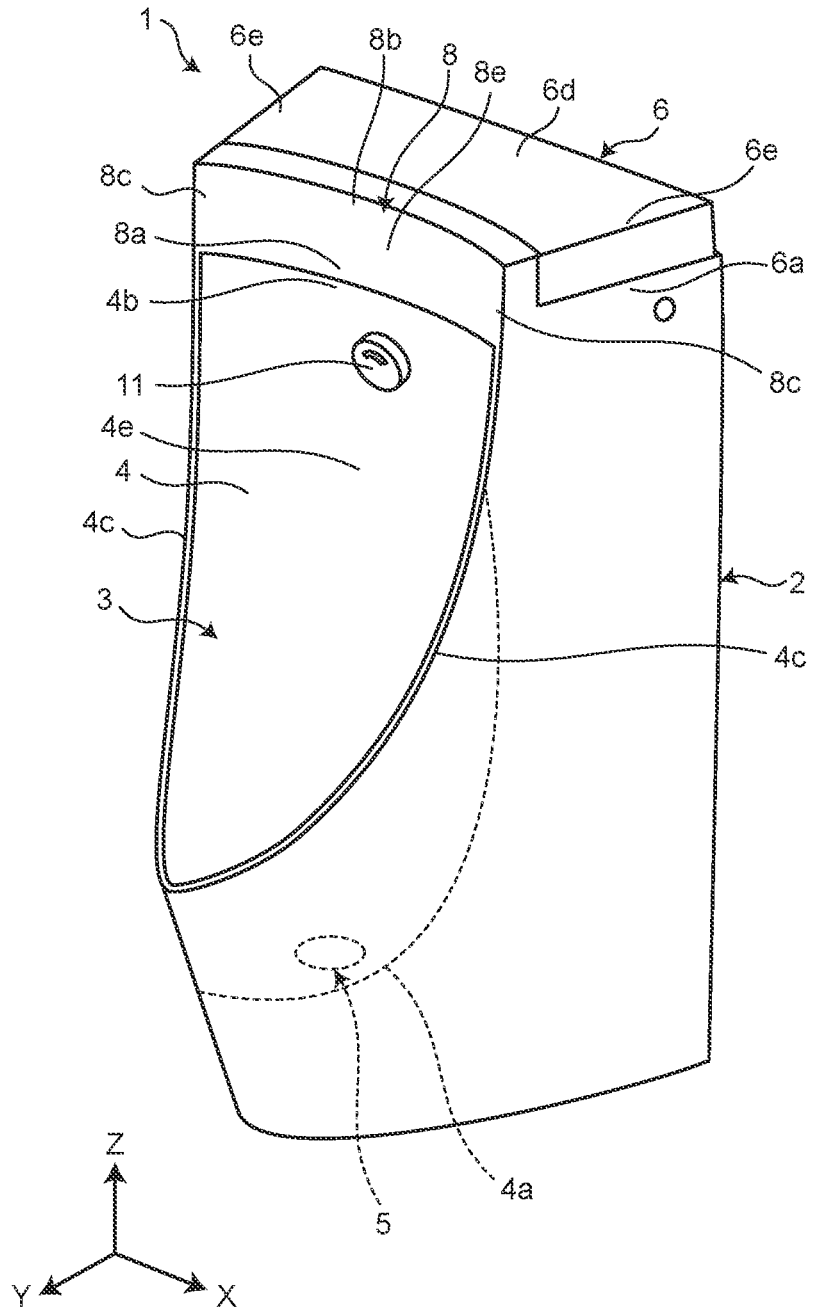
FIG. 1 is a perspective view of a urinal according to an embodiment.
Figure 2:
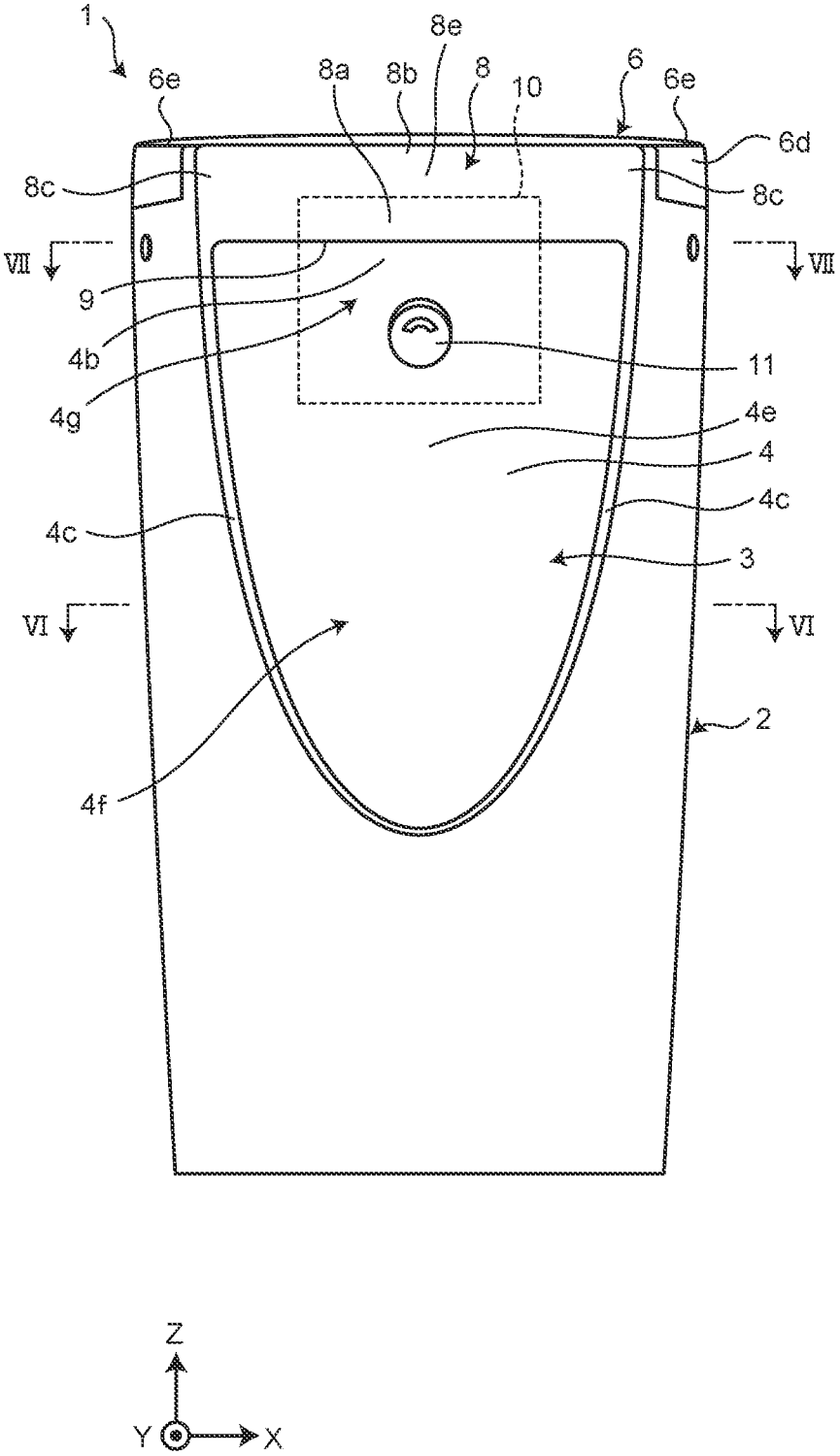
FIG. 2 is a front view of a urinal according to an embodiment.
Figure 3:
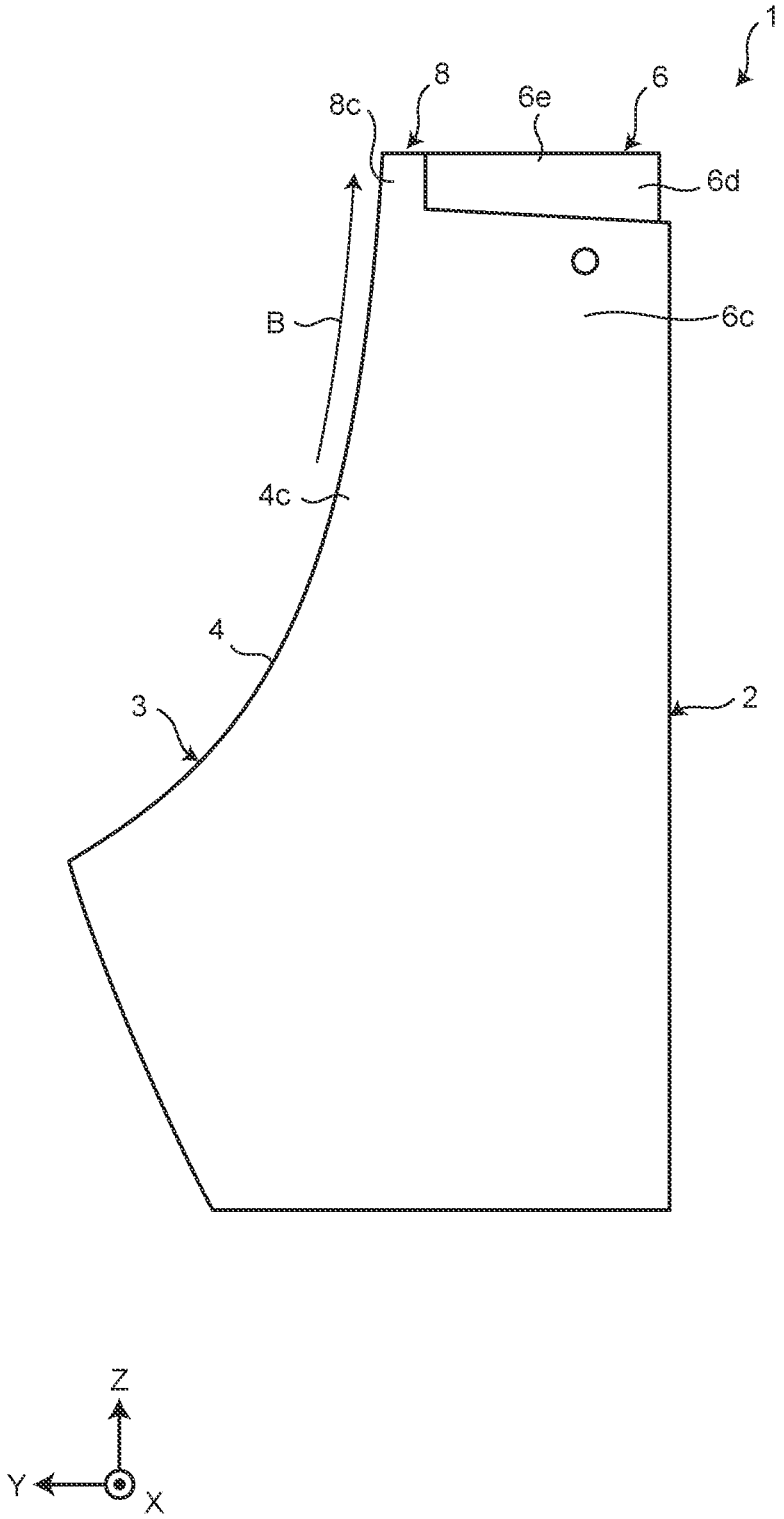
FIG. 3 is a side view of a urinal according to an embodiment.
Figure 4:
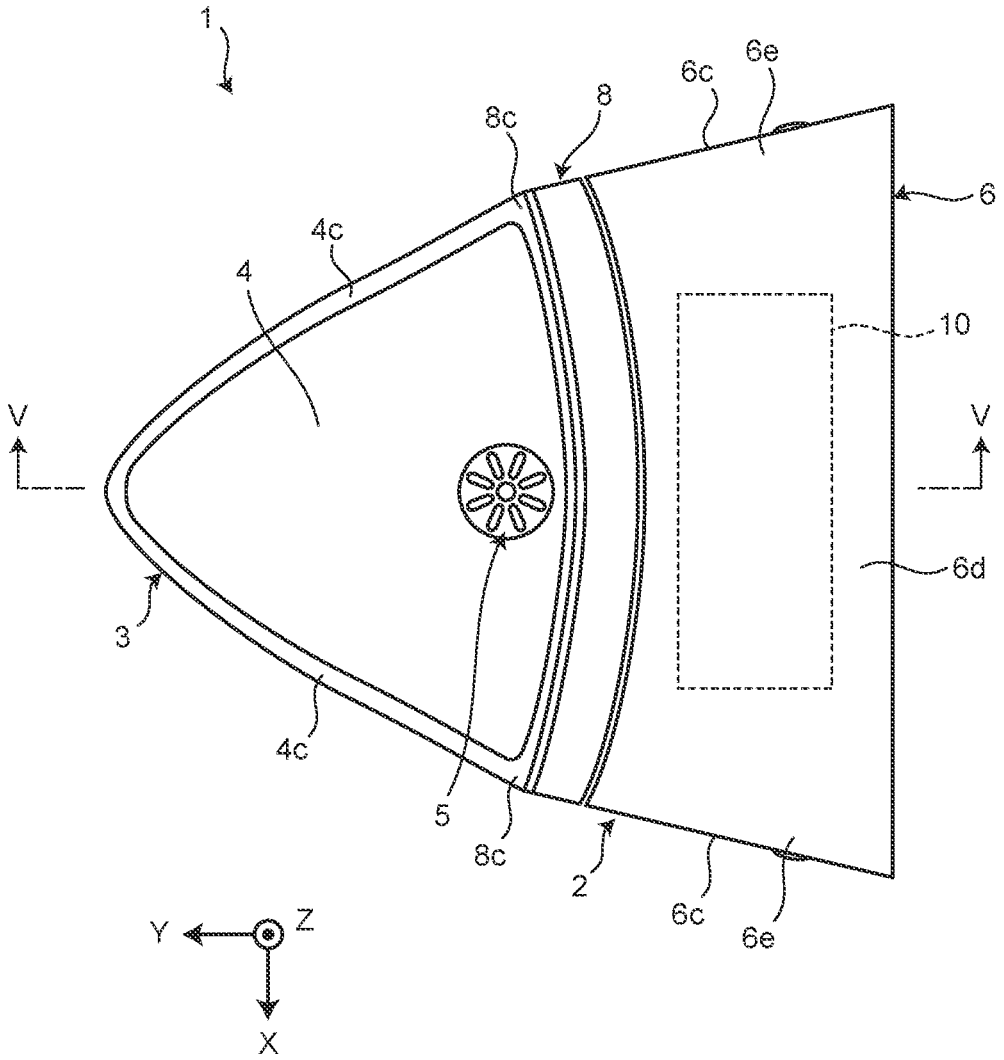
FIG. 4 is a top view of a urinal according to an embodiment.
Figure 5:
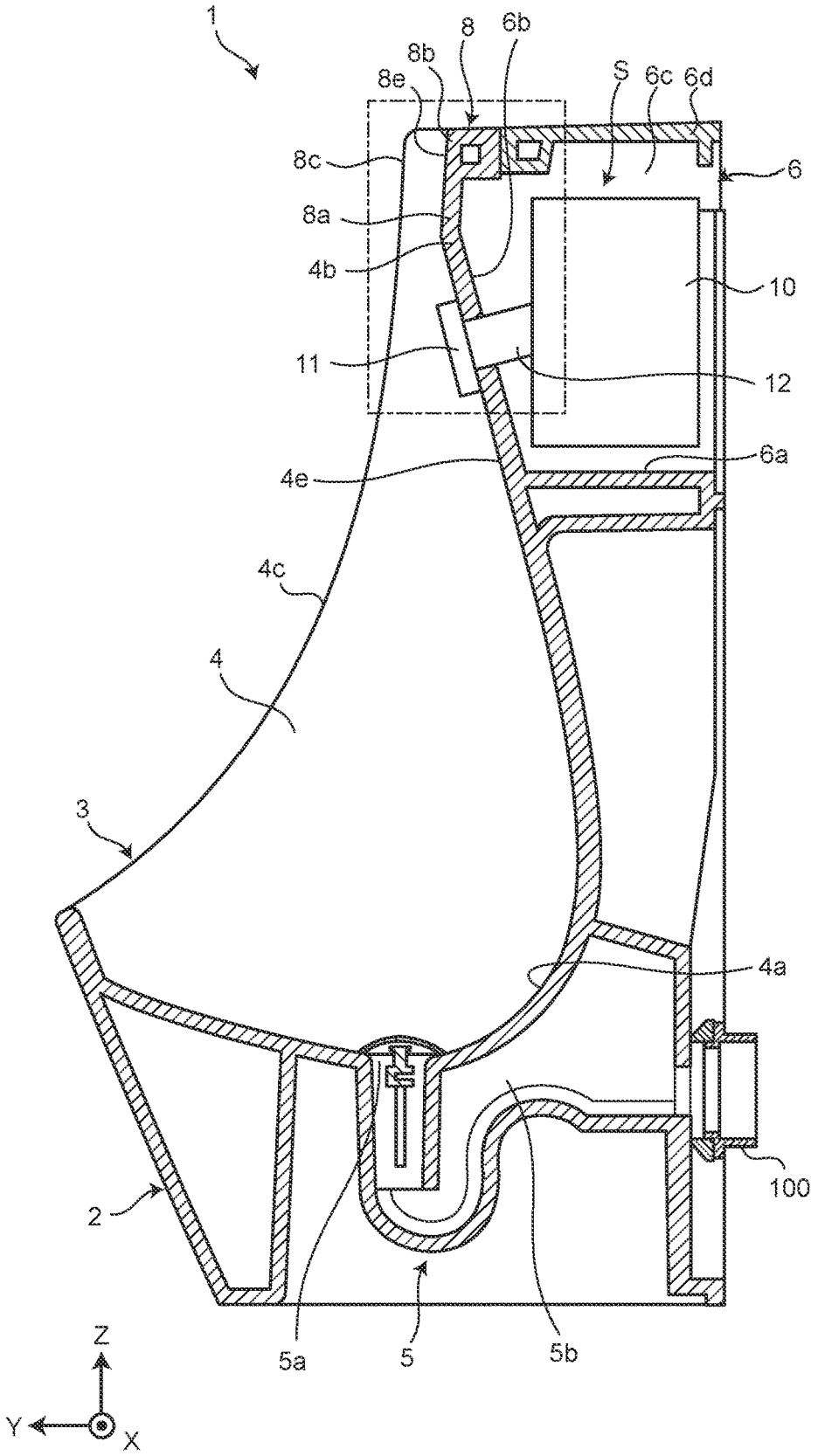
FIG. 5 is a cross-sectional view along a line V-V in FIG. 4.

A urinal 1 according to an embodiment will be explained with reference to FIG. 1 to FIG. 5. FIG. 1 is a perspective view of the urinal 1 according to an embodiment, FIG. 2 is a front view of the urinal 1 according to an embodiment, FIG. 3 is a side view of the urinal 1 according to an embodiment, and FIG. 4 is a top view of the urinal 1 according to an embodiment. Furthermore, FIG. 5 is a cross-sectional view along a line V-V in FIG. 4. Additionally, any of FIG. 1 to FIG. 5 and FIG. 6 and the subsequent figures is a schematic diagram.

Furthermore, in FIG. 1, etc., a three-dimensional orthogonal coordinate system is illustrated where a direction(s) of an X-axis, a direction(s) of a Y-axis, and a direction(s) of a Z-axis that are orthogonal to one another are defined and a positive direction of such a Z-axis is provided as a vertically upward direction, for convenience of explanation. Furthermore, in an under-mentioned explanation, a positive direction of an X-axis, a negative direction of such an X-axis, a positive direction of a Y-axis, and a negative direction of such a Y-axis may be described as a "rightward direction", a "leftward direction", a "frontward direction", and a "backward direction", respectively. Hence, in an under-mentioned explanation, directions of an X-axis, directions of a Y-axis, and directions of a Z-axis may be referred to as leftward and rightward directions, frontward and backward directions, and upward and downward directions (vertical directions), respectively.

As illustrated in FIG. 1 to FIG. 5, the urinal 1 according to an embodiment is installed in a toilet room. The urinal 1 may be a wall-hung type that is installed on a wall surface or may be a floor-mounted type that is installed on a floor surface. The urinal 1 has a urinal body 2 where the urinal body 2 is made of, for example, a ceramic.

The urinal body 2 includes a bowl part 3, a water discharge part 5, a housing part 6, a functional part 10, and a water spout part 11.

The bowl part 3 is formed on a surface (a front surface) that is a frontal surface of the urinal body 2 and faces a user. A bowl surface 4 that receives urine of a user is formed on the bowl part 3. Washing water is spouted from the water spout part 11 to the bowl surface 4 so as to wash the bowl surface 4. Additionally, a detailed shape of the bowl surface 4 of the bowl part 3 will be described later.

As illustrated in FIG. 5, the water discharge part 5 includes a water discharge port 5*a* and a discharge water trap part 5*b*. The water discharge port 5*a* is formed on a lower part of the bowl surface 4 of the bowl part 3 so as to discharge washing water that washes the bowl surface 4. The discharge water trap part 5*b* is connected to a downstream side of the water discharge port 5*a*. The discharge water trap part 5*b* stores washing water so as to form seal water, so that an odor, etc., from a water discharge pipe is/are prevented from flowing back to a side of the bowl part 3. A water discharge socket 100 is connected to a downstream side of the discharge water trap part 5*b*, so that washing water is discharged from the discharge water trap part 5*b* to an external water discharge pipe (non-illustrated) through the water discharge socket 100.

The housing part 6 is formed on an upper part of the bowl part 3 at a back side thereof and houses the functional part 10 (see FIGS. 2, 4, and 5). Additionally, in FIG. 5, etc., the functional part 10 is illustrated by a block for sake of simplicity of illustration thereof.

The housing part 6 has a bottom part 6*a*, a front wall part 6*b*, and left and right side wall parts 6*c*. Then, a space that is surrounded by the bottom part 6*a*, the front wall part 6*b*, and the left and right side wall parts 6*c* is a housing space S that houses the functional part 10. A top lid 6*d* is attachably and detachably attached to an upper part of the housing part 6 from above with respect to the housing part 6. Therefore, an upper part of the housing space S is closed by the top lid 6*d*.

Specifically, the bottom part 6*a* is positioned below the functional part 10. The bottom part 6*a* supports the functional part 10 from below. Additionally, the bottom part 6*a* may directly support the functional part 10 or may indirectly support the functional part 10 through a supporting member. Furthermore, a part or a whole of the functional part 10 may be fixed to and supported by a site other than the bottom part 6*a*.

The front wall part 6*b* is a wall that is formed so as to stand up from a front end part (a front end edge) of the bottom part 6*a*. The left and right side wall parts 6*c* are walls that are formed so as to stand up from front end parts (front end edges) of the bottom part 6*a* in leftward and rightward directions. The bottom part 6*a*, the front wall part 6*b*, and the left and right side wall parts 6*c* are formed integrally and the housing space S with a back side that is opened is formed so as to be surrounded by such a bottom part 6*a*, a front wall part 6*b*, and left and right side wall parts 6*c*.

Thus, the housing part 6 is not arranged more highly above the bowl part 3 but is arranged on an upper part of the bowl part 3 at a back side thereof in such a manner that the functional part 10 is hidden in the bowl part 3. Hence, the urinal 1 has a compact appearance.

The functional part 10 has a function of supplying washing water to the water spout part 11, etc. For the functional part 10, it is possible to use, for example, an automatic washing unit that automatically washes the bowl surface 4.

As an example, the functional part 10 includes a water supply channel, a water shut-off valve, a valve unit (where none of them is illustrated), etc. A water supply channel is a flow channel where washing water is supplied from a water supply source (non-illustrated) such as a water tap. A water shut-off valve is connected to a water supply channel and supplies and stops washing water for a valve unit, etc. A valve unit is connected to a downstream side of a water shut-off valve in a water supply channel and has an electromagnetic valve that is electrically openable and closable, a constant flow rate valve that limits inflowing washing water to a predetermined flow rate range, etc. A valve unit opens an electromagnetic valve based on a detection signal that indicates presence or absence of a user from a human body detection sensor (non-illustrated) so as to cause washing water in a water supply channel to flow. The water spout part 11 is connected to a downstream side of the functional part 10 (a valve unit) through a connection part 12 (see FIG. 5) where washing water that flows in a water supply channel is supplied to the water spout part 11 through the connection part 12 and is spouted to the bowl surface 4.

Although the functional part 10 includes an instrument such as a valve unit as described above, another/other instrument(s) may be included therein, depending on a specification, etc., of the urinal 1. For example, an electrical generator that generates electricity by using a flow of washing water in a water supply channel, etc., may be included in the functional part 10. Furthermore, a vacuum breaker that prevents sewage water from flowing backward in a water supply channel may be included in the functional part 10, depending on a country and/or a place where the urinal 1 is installed, so as to comply with a rule that is set in such a country, etc.

Thus, a size of the functional part 10 is different depending on a function that is possessed thereby. Hence, it is preferable for the housing part 6 that houses the functional part 10 to hold the housing space S sufficiently. However, a design of the urinal 1 is needed to be taken into consideration, so that the housing space S in the housing part 6 is needed to be held for the urinal 1 without disturbing such a design.

Hence, the urinal 1 according to the present embodiment is configured in such a manner that it is possible to hold the housing space S in the housing part 6 without disturbing a design thereof.

Specifically, the urinal 1 includes an extension part 8. The extension part 8 is formed so as to extend upward from an upper end part 4*b* of the bowl surface 4. Before continuing an explanation of the extension part 8, the bowl surface 4 will be explained in detail.

The bowl surface 4 is formed so as to be a surface that is recessed toward an inner side (a center side of the bowl part 3 in leftward and rightward directions) and a rear side (a back side) more deeply as moving downward from the upper end part 4*b*. Furthermore, the bowl surface 4 is formed so as to be a surface that is gently curved toward a back side from a vicinity of a central part thereof in upward and downward directions to a lower part thereof. Furthermore, the water discharge part 5 as described above is provided on a lower part of the bowl surface 4. The water spout part 11 as described above is provided on an upper part of the bowl surface 4.

Figure 6:
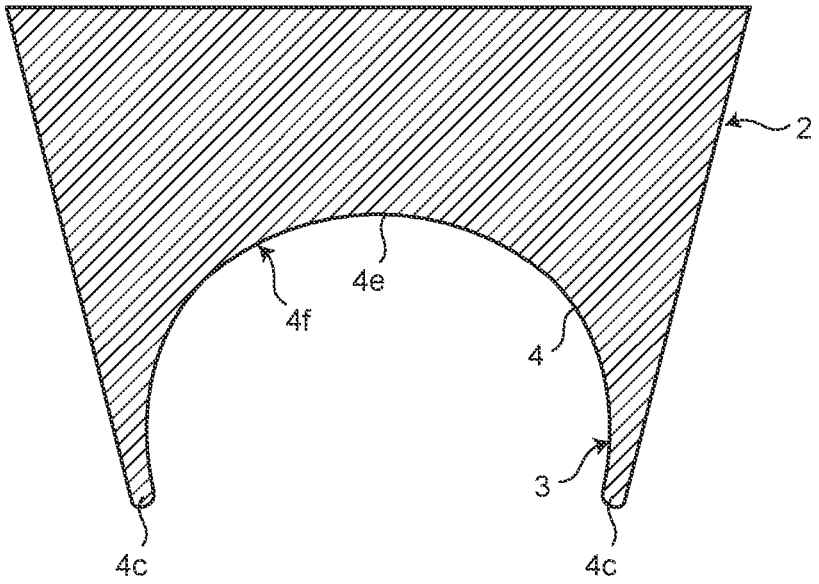
FIG. 6 is an end view along a line VI-VI in FIG. 2.
Figure 7:
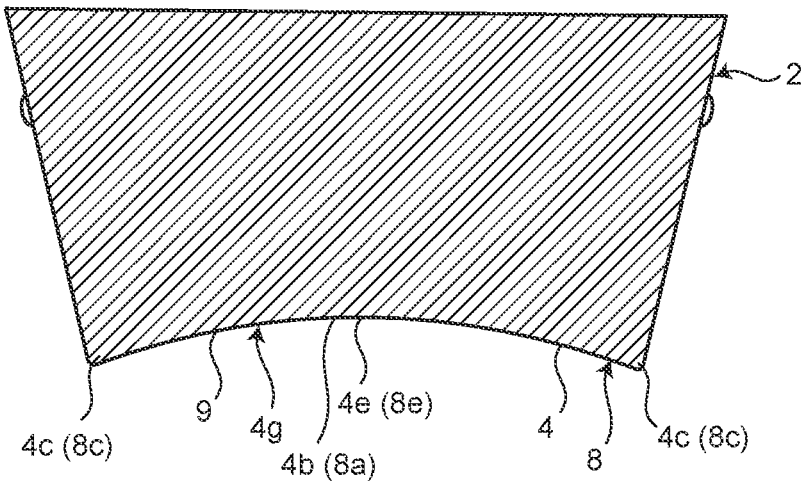
FIG. 7 is an end view along a line VII-VII in FIG. 2.

Herein, the bowl surface 4 will be explained also with reference to FIG. 6 and FIG. 7. FIG. 6 is an end view along a line VI-VI in FIG. 2 and FIG. 7 is an end view along a line VII-VII in FIG. 2. Additionally, in FIG. 6 and FIG. 7, a space (for example, the housing space S, etc.) that is present at a back side of the bowl surface 4 is also shaded for convenience of understanding. Additionally, FIG. 7 is also an end view of a boundary part between the bowl surface 4 and the extension part 8.

As illustrated in FIGS. 2, 6, and 7, etc., the bowl surface 4 has a front part 4*e* that faces a user. The front part 4*e* is formed into a concave curved surface shape (a circular arc shape) that is recessed backward. Furthermore, the front part 4*e* is formed into a concave curved surface shape that is continuous in leftward and rightward directions. Such a front part 4*e* is formed in such a manner that a concave curved surface shape thereof is different between an upper part side and a lower part side thereof.

Specifically, as illustrated in FIG. 6, etc., a lower part side of the front part 4*e* is a part with a composite shape that is a combination of circular arcs that have a plurality of radii of curvature R or a combination of circular arcs that have a plurality of radii of curvature R and a straight line(s) so as to form a composite R area 4*f*.

The bowl surface 4 (the front part 4*e*) in the composite R area 4*f* is formed in such a manner that a radius of curvature R of a circular arc thereof is continuously (gradually) changed so as to be recessed toward a rear side (a back side) more deeply as moving from an upper part thereof to a lower end part 4*a* (see FIG. 5) of the bowl surface 4. Furthermore, end parts 4*c* of the bowl surface 4 at left and right sides thereof in the composite R area 4*f* are formed so as to protrude forward, and thereby, side wall parts thereof are formed at left and right sides thereof.

As illustrated in FIG. 7, etc., an upper part side of the front part 4*e* is a part with a shape that is a circular arc that has a single radius of curvature R, so as to form a single R area 4*g*. In other words, the bowl surface 4 (the front part 4*e*) in the single R area 4*g* is formed into a single circular arc shape where a curved surface thereof has a substantially single radius of curvature R. Additionally, "a circular arc that has a single radius of curvature R" as described above does not need to have a strictly single radius of curvature R where it is sufficient that such a radius of curvature R is a circular arc that is not substantially changed in leftward and rightward directions.

Furthermore, none of side wall parts that protrude forward from the end parts 4*c* of the bowl surface 4 at left and right sides thereof is formed on the bowl surface 4 (the front part 4*e*) in the single R area 4*g*. In other words, an upper part of the bowl surface 4 is formed by only the front part 4*e* where no side wall part is formed thereon.

The bowl surface 4 (the front part 4*e*) in the single R area 4*g* is formed in such a manner that a radius of curvature R of a circular arc thereof is gradually decreased (a curvature thereof is gradually increased) so as to be recessed toward a rear side (a back side) more deeply as moving downward from the upper end part 4*b* of the bowl surface 4.

Furthermore, the bowl surface 4 is formed in such a manner that a radius of curvature R of a circular arc thereof is gradually changed at a boundary part between the single R area 4*g* and the composite R area 4*f*, and in other words, is formed in such a manner that such a radius of curvature R is continuously changed.

Thus, the bowl surface 4 according to the present embodiment is formed into a concave curved surface shape that is recessed backward, and is formed in such a manner that a radius of curvature thereof is continuously changed from the lower end part 4*a* to an upper side thereof.

Furthermore, a side wall part is not formed at an upper part side of the bowl surface 4 according to the present embodiment, so that it is possible to improve a design of the urinal 1.

Figure 8:
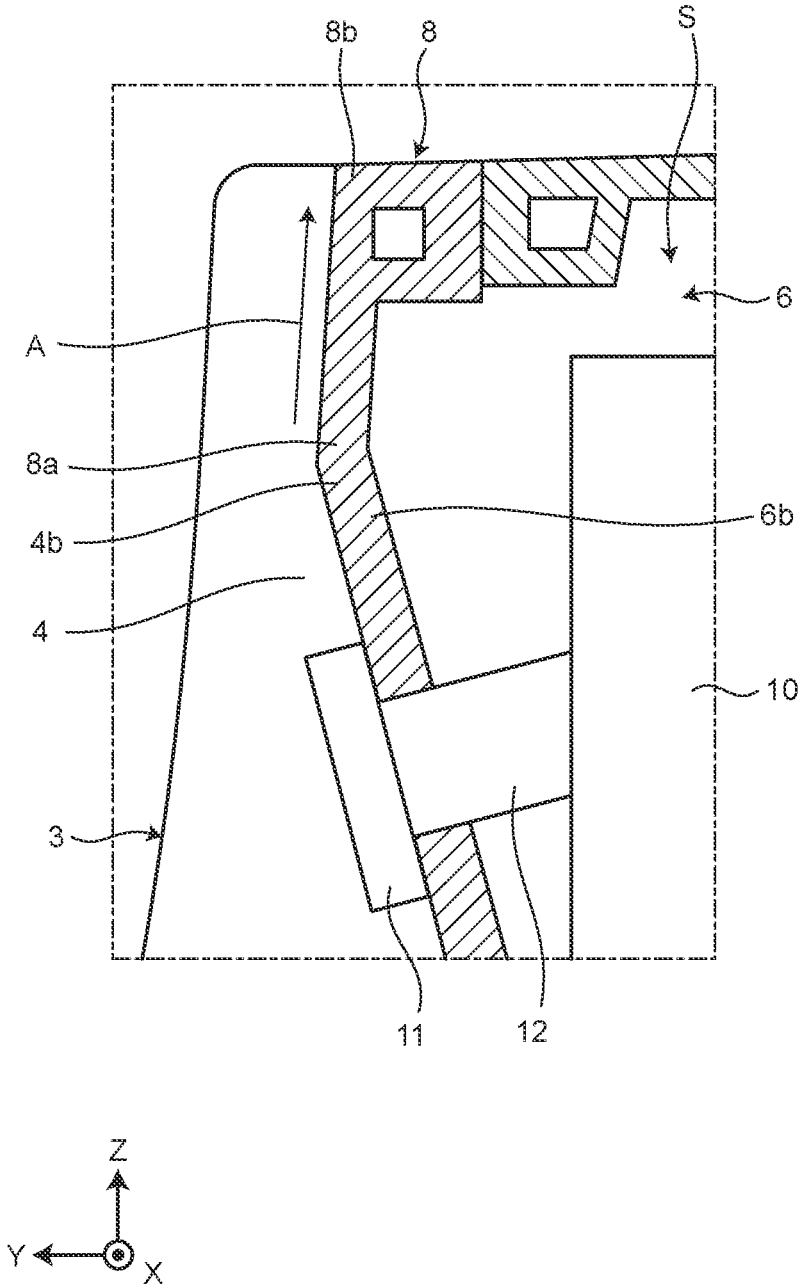
FIG. 8 is an enlarged cross-sectional view that enlarges and illustrates a part that is surrounded by a dash-dot line in FIG. 5.

As illustrated in FIG. 1 to FIG. 5, the extension part 8 is formed so as to extend upward from the upper end part 4*b* of the bowl surface 4 that is formed as described above. Herein, the extension part 8 will be explained also with reference to FIG. 8. FIG. 8 is an enlarged cross-sectional view that enlarges and illustrates a part that is surrounded by a dash-dot line in FIG. 5.

As illustrated in FIG. 5 and FIG. 8, etc., the extension part 8 is formed so as to be positioned at a front side of the housing part 6. In other words, the extension part 8 forms a part of the front wall part 6*b* of the housing part 6. Additionally, although the extension part 8 in the present embodiment forms a part of the front wall part 6*b* of the housing part 6, this is not limiting and a whole of the front wall part 6*b* may be formed thereby. That is, it is sufficient that the extension part 8 forms at least a part of the front wall part 6*b* of the housing part 6. Furthermore, the extension part 8 is formed at a position where the bowl surface 4 is covered thereby from above, so that it is also possible to refer to the extension part 8 as an eave part.

As indicated by an arrow A in FIG. 8, the extension part 8 is formed so as to slope backward from a lower end part 8*a* thereof to an upper side thereof. In other words, the extension part 8 is formed in such a manner that an upper end part 8*b* thereof and the lower end part 8*a* are positioned at a back side and a front side, respectively, in a side view, and it slopes upward from the lower end part 8*a* to the upper end part 8*b*.

Thus, the extension part 8 according to the present embodiment is configured in such a manner that it is formed so as to extend upward from the upper end part 4*b* of the bowl surface 4 and forms a part of the front wall part 6*b* of the housing part 6, so that it is possible to increase the housing space S of the housing part 6 by the extension part 8. Thereby, it is possible for the housing part 6 according to the present embodiment to hold the housing space S for the functional part 10 sufficiently, and in other words, it is possible to hold the housing space S that is dependent on a size of the functional part 10.

Furthermore, the extension part 8 is formed so as to slope backward from the lower end part 8*a* to an upper side thereof, so that it is possible to reduce or prevent disturbing of a design of the urinal 1 that includes the bowl surface 4. Furthermore, the extension part 8 slopes backward, so that, for example, a user readily urinates while checking a direction of excreted urine, that is, it is possible to improve visibility at a time of urination thereof.

As illustrated in FIG. 3, the extension part 8 is formed so as to be smoothly continuous with the end parts 4*c* of the bowl surface 4 at left and right sides thereof in a side view. Specifically, end parts 8*c* of the extension part 8 at left and right sides thereof and the end parts 4*c* of the bowl surface 4 at left and right sides thereof are formed in such a manner that a radius of curvature R thereof is continuously changed from the end parts 4*c* of the bowl surface 4 to the end parts 8*c* of the extension part 8 in a side view.

For example, the end parts 4*c* of the bowl surface 4 at left and right sides thereof and the end parts 8*c* of the extension part 8 at left and right sides thereof are formed into a concave curved surface shape that is recessed backward in a side view. The end parts 4*c* of the bowl surface 4 at left and right sides thereof are formed in such a manner that a radius of curvature R of a circular arc thereof is gradually increased as moving upward in a side view. The end parts 8*c* of the extension part 8 at left and right sides thereof are formed so as to extend upward from the end parts 4*c* of the bowl surface 4 and are formed in such a manner that a radius of curvature R thereof is continuously changed (for example, is gradually increased) from the end parts 4*c* of the bowl surface 4 in a side view (see an arrow B in FIG. 3).

Thereby, it is possible for the present embodiment to hold the housing space S of the housing part 6 by the extension part 8 and improve a design of a side surface line of the urinal 1.

For the extension part 8, as illustrated in FIG. 7 that is an end view of a boundary part between the bowl surface 4 and the extension part 8, the extension part 8 has a front part 8*e* that faces a user. The front part 8*e* is formed into a concave curved surface shape (a circular arc shape) that is recessed backward. Furthermore, the front part 8*e* is continuously formed into a concave curved surface shape in leftward and rightward directions.

Then, the extension part 8 is formed in such a manner that a radius of curvature R of the lower end part 8*a* (see FIG. 5) is continuous with a radius of curvature R of the upper end part 4*b* (see FIG. 5) of the bowl surface 4. Furthermore, although radii of curvature R of the lower end part 8*a* and the upped end part 8*b* (see FIG. 5) in the extension part 8 are substantially identical radii of curvature R, this is not limiting and such radii of curvature R may be changed as concentric circles, etc.

Thus, formation is executed in such a manner that a radius of curvature R of the lower end part 8*a* of the extension part 8 is continuous with a radius of curvature R of the upper end part 4*b* of the bowl surface 4, so that the upper end part 4*b* of the bowl surface 4 to the lower end part 8*a* of the extension part 8 appear to be smoothly continuous along a line of sight of a user and it is possible to improve a design thereof. Furthermore, the upper end part 4*b* of the bowl surface 4 to the lower end part 8*a* of the extension part 8 are smoothly continuous, so that it is possible to improve cleanability for a vicinity of a boundary between the upper end part 4*b* of the bowl surface 4 and the lower end part 8*a* of the extension part 8.

As illustrated in FIG. 2, etc., a boundary line 9 between the upper end part 4*b* of the bowl surface 4 and the lower end part 8*a* of the extension part 8 is a straight line shape in a front view. In other words, the boundary line 9 between the upper end part 4*b* of the bowl surface 4 and the lower end part 8*a* of the extension part 8 is a straight line shape that extends in leftward and rightward directions. Furthermore, such a boundary line 9 with a straight line shape extends so as to be continuous with the end parts 4*c* of the bowl surface 4 at left and right sides thereof (or the end parts 8*c* of the extension part 8 at left and right sides thereof).

Thus, the boundary line 9 between the upper end part 4*b* of the bowl surface 4 and the lower end part 8*a* of the extension part 8 is a straight line shape in a front view, so that it is possible to improve a design of a vicinity of the boundary line 9 in a front view. Furthermore, the boundary line 9 is a straight line shape in a front view, so that it is possible to improve cleanability for a vicinity of the boundary line 9.

Furthermore, in the urinal 1 according to the present embodiment, end parts that form an appearance thereof are formed so as to have identical R shapes.

For example, the end parts 4*c* of the bowl surface 4 at left and right sides thereof, the end parts 8*c* of the extension part 8 at left and right sides thereof, the upper end part 8*b* of the extension part 8, and the lower end part 8*a* of the extension part 8 are formed so as to have identical R shapes. In other words, formation is executed in such a manner that shapes of folding parts of respective end parts such as the end parts 4*c* of the bowl surface 4 at left and right sides thereof are identical R shapes. Additionally, although identical R shapes refer to, for example, being formed into shapes that include circular arcs with identical radii of curvature R, this is not limiting.

Furthermore, also in the housing part 6, end parts 6*e* of the top lid 6*d* at left and right sides thereof are formed so as to have R shapes that are identical to those of respective end parts such as the end parts 4*c* of the bowl surface 4 at left and right sides thereof as described above (see FIGS. 2 and 4). For details, the end parts 6*e* of the top lid 6*d* at left and right sides thereof in a top view are formed so as to have R shapes that are identical to those of respective end parts such as the end parts 4*c* of the bowl surface 4 at left and right sides thereof.

Thus, end parts that form an appearance of the urinal 1 are formed so as to have identical R shapes, so that it is possible to further improve a design of the urinal 1.

Additionally, although all end parts of the end parts 8*c* of the extension part 8 at left and right sides thereof, the upper end part 8*b* of the extension part 8, the lower end part 8*a* of the extension part 8, and the end parts 6*e* of the top lid 6*d* at left and right sides thereof are formed so as to have identical R shapes in the above description(s), this is not limiting. That is, it is sufficient that at least two or more end parts among respective end parts as described above are formed so as to have identical R shapes. Additionally, for more details, as a radius of curvature for an R shape of an end part is set at approximately 6 mm, sharpness in manufacturability of a ceramic and/or a design of an appearance is developed significantly.

As has been described above, a urinal 1 according to an embodiment includes a bowl part 3, a housing part 6, and an extension part 8. The bowl part 3 receives urine on a bowl surface 4 thereof. The housing part 6 is formed on an upper part of the bowl part 3 at a back side thereof and houses a functional part 10 therein. The extension part 8 is formed so as to extend upward from an upper end part 4*b* of the bowl surface 4 and forms at least a part of a front wall part 6*b* of the housing part 6. Furthermore, the extension part 8 is formed so as to slope backward from a lower end part 8*a* thereof to an upper side thereof. Thereby, it is possible to hold a housing space for a functional part in a housing part without disturbing a design of a urinal 1.

An aspect of an embodiment aims to provide an urinal that is capable of holding a housing space for a functional part in a housing part without disturbing a design thereof.

A urinal according to an aspect of an embodiment is characterized by including a bowl part that receives urine on a bowl surface thereof, a housing part that is formed on an upper part of the bowl part at a back side thereof and houses a functional part therein, and an extension part that is formed so as to extend upward from an upper end part of the bowl surface and forms at least a part of a front wall part of the housing part, wherein the extension part is formed so as to slope backward from a lower end part thereof to an upper side thereof.

Thus, an extension part is formed so as to extend upward from an upper end part of a bowl surface and is configured to form a part of a front wall part of a housing part, so that it is possible to increase a housing space of such a housing part by such an extension part. Thereby, it is possible to hold a housing space for a functional part in a housing part sufficiently, in other words, it is possible to hold a housing space that is dependent on a size of such a functional part.

Furthermore, an extension part is formed so as to slope backward from a lower end part thereof to an upper side thereof, so that it is possible to reduce or prevent disturbing of a design of a urinal that includes a bowl surface. Furthermore, an extension part slopes backward, so that, for example, a user readily urinates while checking a direction of excreted urine, that is, it is possible to improve visibility at a time of urination.

Furthermore, it is characterized in that end parts of the extension part at left and right sides thereof and end parts of the bowl surface at left and right sides thereof are formed in such a manner that a radius of curvature thereof is continuously changed from end parts of the bowl surface to end parts of the extension part in a side view thereof.

Thereby, it is possible to hold a housing space of a housing part by an extension part and improve a design of a side surface line of a urinal.

Furthermore, it is characterized in that the bowl surface is formed into a concave curved surface shape that is recessed backward and is formed in such a manner that a radius of curvature thereof is continuously changed from a lower end part thereof to an upper side thereof, and the extension part is formed into a concave curved surface shape that is recessed backward and is formed in such a manner that a radius of curvature of a lower end part thereof is continuous with a radius of curvature of an upper end part of the bowl surface.

Thus, formation is executed in such a manner that a radius of curvature of a lower end part of an extension part is continuous with a radius of curvature of an upper end part of a bowl surface, so that such an upper end part of a bowl surface to such a lower end part of an extension part appear to be smoothly continuous along a line of sight of a user and thus it is possible to improve a design. Furthermore, an upper end part of a bowl surface to a lower end part of an extension part are smoothly continuous, so that it is possible to improve cleanability in a vicinity of a boundary between such an upper end part of a bowl surface and such a lower end part of an extension part.

Furthermore, it is characterized in that a boundary line between an upper end part of the bowl surface and a lower end part of the extension part has a straight line shape in a front view thereof.

Thus, a boundary line between an upper end part of a bowl surface and a lower end part of an extension part has a straight line shape in a front view thereof, so that it is possible to improve a design in a vicinity of such a boundary line in such a front view thereof. Furthermore, a boundary line has a straight line shape in a front view thereof, so that it is possible to improve cleanability in a vicinity of such a boundary line.

It is characterized in that at least two or more end parts among respective end parts of end parts of the bowl surface at left and right sides thereof, end parts of the extension part at left and right sides thereof, an upper end part of the extension part, and a lower end part of the extension part are formed so as to have identical R shapes.

Thus, end parts that form an appearance of a urinal are formed so as to have identical R shapes, so that it is possible to further improve a design of such a urinal.

According to an aspect of an embodiment, it is possible to hold a housing space for a functional part in a housing part without disturbing a design thereof.

APPENDIX (1) A urinal, characterized by including:

a bowl part that receives urine on a bowl surface thereof;

a housing part that is formed on an upper part of the bowl part at a back side thereof and houses a functional part therein; and an extension part that is formed so as to extend upward from an upper end part of the bowl surface and forms at least a part of a front wall part of the housing part, wherein the extension part is formed so as to slope backward from a lower end part thereof to an upper side thereof.

(2) The urinal according to (1), characterized in that end parts of the extension part at left and right sides thereof and end parts of the bowl surface at left and right sides thereof are formed in such a manner that a radius of curvature thereof is continuously changed from end parts of the bowl surface to end parts of the extension part in a side view thereof.

(3) The urinal according to (1) or (2), characterized in that:

the bowl surface is formed into a concave curved surface shape that is recessed backward and is formed in such a manner that a radius of curvature thereof is continuously changed from a lower end part thereof to an upper side thereof; and the extension part is formed into a concave curved surface shape that is recessed backward and is formed in such a manner that a radius of curvature of a lower end part thereof is continuous with a radius of curvature of an upper end part of the bowl surface.

(4) The urinal according to any one of (1) to (3), characterized in that a boundary line between an upper end part of the bowl surface and a lower end part of the extension part has a straight line shape in a front view thereof.

(5) The urinal according to any one of (1) to (4), characterized in that at least two or more end parts among respective end parts of end parts of the bowl surface at left and right sides thereof, end parts of the extension part at left and right sides thereof, an upper end part of the extension part, and a lower end part of the extension part are formed so as to have identical R shapes.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A urinal, comprising:

a bowl part that receives urine on a bowl surface thereof;

a housing part that is formed on an upper part of the bowl part at a back side thereof and houses a functional part therein; and an extension part that is formed to extend upward from an upper end part of the bowl surface and forms at least a part of a front wall part of the housing part, wherein the extension part comprises a front part that is formed to slope backward from a lower end part thereof to an upper side thereof and a top part that is formed to be continuous with an upper end part of the front part and extend backward, the lower end part of the front part is the upper end part of the bowl surface, and the front part slopes upward and backward from the lower end part to the upper end part thereof.

2. The urinal according to claim 1, wherein end parts of the extension part at left and right sides thereof and end parts of the bowl surface at left and right sides thereof are formed in such a manner that a radius of curvature thereof is continuously changed from end parts of the bowl surface to end parts of the extension part in a side view thereof.

3. The urinal according to claim 1, wherein:

the bowl surface is formed into a concave curved surface shape that is recessed backward and is formed in such a manner that a radius of curvature thereof is continuously changed from a lower end part thereof to an upper side thereof; and the extension part is formed into a concave curved surface shape that is recessed backward and is formed in such a manner that a radius of curvature of the lower end part thereof is continuous with a radius of curvature of the upper end part of the bowl surface.

4. The urinal according to claim 1, wherein a boundary line between the upper end part of the bowl surface and the lower end part of the extension part has a straight line shape in a front view thereof.

5. The urinal according to claim 1, wherein at least two or more end parts among end parts of the bowl surface at left and right sides thereof, end parts of the extension part at left and right sides thereof, the upper end part of the extension part, and the lower end part of the extension part are formed to have identical R shapes.

* * * * *